United States Patent [19]

Soukup et al.

[11] 4,330,038

[45] May 18, 1982

[54] OIL RECLAMATION PROCESS

[75] Inventors: Charles L. Soukup, Schofield, Wis.; Richard K. Kerr, Calgary, Canada

[73] Assignee: Zimpro-AEC Ltd., Calgary, Canada

[21] Appl. No.: 149,721

[22] Filed: May 14, 1980

[51] Int. Cl.[3] ..... E21B 43/24; E21B 43/34

[52] U.S. Cl. ..... 166/267; 166/57; 166/75 R; 166/266; 166/272; 166/302; 166/303; 166/305 R

[58] Field of Search ..... 166/57, 59, 75 R, 265, 166/266, 267, 268, 272, 274, 303, 305 R

[56] References Cited

U.S. PATENT DOCUMENTS

| | | | |
|---|---|---|---|
| 2,324,172 | 7/1943 | Parkhurst | 166/266 |
| 2,734,578 | 2/1956 | Walter | 166/272 |
| 2,824,058 | 2/1958 | Zimmermann | 210/63 R |
| 3,228,467 | 1/1966 | Schlinger et al. | 166/266 |
| 3,442,332 | 5/1969 | Keith | 166/266 |
| 3,871,451 | 3/1975 | Brown | 166/267 |
| 3,948,323 | 4/1976 | Sperry et al. | 166/303 |
| 3,993,135 | 11/1976 | Sperry et al. | 166/303 |
| 4,007,786 | 2/1977 | Schlinger | 166/266 |
| 4,078,613 | 3/1978 | Hamrick . | |
| 4,100,730 | 7/1978 | Pradt | 210/63 R X |
| 4,246,966 | 1/1981 | Stoddard et al. | 166/267 |

OTHER PUBLICATIONS

Havlena, "Some Innovative Approaches Which May Facilitate Production of Heavy Crudes", First International Conference on the Future of Heavy Crude and Tar Sands, Report No. 39, Jun. 4–12, 1979.

Whalley et al., "Water Conservation in a Steam Stimulation Project", First International Conference on the Future of Heavy Crude and Tar Sands, Report No. 61, Jun. 4–12, 1979.

Stalkup, "Carbon Dioxide Miscible Flooding: Past, Present, and Outlook for the Future", Journal of Petroleum Technology, Aug. 1978, pp. 1102–1112.

*Primary Examiner*—Stephen J. Novosad
*Assistant Examiner*—George A. Suchfield
*Attorney, Agent, or Firm*—Allen H. Erickson; Thomas L. Johnson; B. Woodrow Wyatt

[57] ABSTRACT

A process for enhanced oil recovery by gas injection into oil-bearing formations which comprises wet oxidizing combustible carbonaceous materials with oxygen, air or a mixture of oxygen and air to obtain a gas comprising a mixture of water vapor and carbon dioxide (and nitrogen in the event air is used), substantially free of oxides of sulfur and nitrogen; injecting said gaseous mixture into an oil-bearing formation to produce a mixture of oil and water; extracting said mixture of oil and water from the oil-bearing formation; separating the water from the latter mixture; and recycling the water to the wet oxidation reactor. Residual oil in the recycled water provides additional fuel for the wet oxidation reaction, and at the same time the need for costly water treatment is eliminated.

40 Claims, 2 Drawing Figures

OIL RECLAMATION PROCESS

BACKGROUND OF THE INVENTION

1. Field of the Invention

This invention relates to an improved process for oil reclamation by gas injection into oil-bearing formations in which process the gas is produced by a wet oxidation reaction.

2. Description of the Prior Art

Conventional methods of recovering crude oil from underground reservoirs succeed in producing only about 30 percent of the total oil in the underground formation. The term "Enhanced Oil Recovery" (EOR) refers to techniques that are in use or have been proposed for the purpose of recovering all, or a portion of, the 70 percent of the oil remaining in these formations. In addition, some of the heavier (more viscous) crude oils cannot be produced at all without the use of EOR. For a detailed description of the prior art see "Enhanced Oil-Recovery Techniques—State-of-the-Art Review", by N. Gangoli and G. Thodos, *Journal of Canadian Petroleum Technology,* pp. 13–20 (October–December 1977).

The EOR processes include vapor or gas injection methods of which the following are exemplary:

(a) Steam Flooding

Steam is injected into a reservoir and oil is produced at an adjacent well (steam drive) or, at a later time, from the same well that is used for injection (steam soak or "huff and puff"). The steam heats the oil and reduces its viscosity so that it can flow to the production well; for example, see Bergstrom U.S. Pat. No. 3,057,404 (Oct. 9, 1962), and Schlinger U.S. Pat. No. 4,007,786 (Feb. 15, 1977).

(b) Carbon Dioxide Miscible Flooding

Carbon dioxide is injected into a reservoir and oil is produced from an adjacent well. The carbon dioxide dissolves in the oil and the viscosity of the mixture is significantly reduced compared to that of the native oil; for example, see Keith U.S. Pat. No. 3,442,332 (May 6, 1969), Brown U.S. Pat. No. 3,871,451 (Mar. 18, 1975), and "Carbon Dioxide Miscible Flooding: Past, Present, and Outlook for the Future" by F. I. Stalkup, *Journal of Petroleum Technology,* pp. 1102–1112 (August 1978).

(c) Gas Pressurization

Inert gas ("flue gas", "exhaust gas", nitrogen, etc.) is injected into a reservoir and oil is produced from an adjacent well. Gas pressure drives the oil toward the production well; for example see "Enhanced-recovery inert gas processes compared", by K. Wilson, *The Oil and Gas Journal,* pp. 162–166, 171–2 (July 31, 1978).

It has also become evident that combinations of the above techniques, i.e. mixtures of inert gas, nitrogen ($N_2$), carbon dioxide ($CO_2$) and water vapor (steam), can have significant benefits for EOR, particularly for heavy oils; for example, see West et al. U.S. Pat. No. 3,782,470 (Jan. 1, 1974) and Sperry et al. U.S. Pat. No. 3,948,323 (Apr. 6, 1976).

Different mixtures of $N_2$, $CO_2$ and steam will have different effects on oil recovery, and for a given oil reservoir a particular composition will optimize oil recovery. For example, it is possible to produce steam by means of a conventional boiler and then blend in with the steam either compressed flue gas or carbon dioxide. It is also possible to burn fuel in a high pressure combustor and inject water into the hot gas stream generated thereby, as taught by Sperry et al. U.S. Pat. Nos. 3,948,323 and 3,993,135, and Walter U.S. Pat. No. 2,734,578.

There are problems with these techniques in the prior art. Steam generators for EOR, often called "oil field steam flooders", must burn expensive and scarce fuels such as natural gas, refined petroleum products, or in some cases, the oil that is produced by the EOR technique itself. Burning even clean fuels, but especially sulphur containing produced oil, generates air pollution problems. Feedwater for oil field flooders must be 100 percent made up, since there is no condensate return. The condensed water produced along with the oil must be treated before disposal. In addition to inorganic contaminants, this produced water contains residual oil which is uneconomical to recover by present technology. It has been proposed to use the produced water as feedwater for the steam flooders, but this requires even more elaborate and expensive treatment, including deoiling, softening to a hardness level below 5 ppm, and silica reduction. Several water treatment schemes have been proposed by M. J. Whalley and T. M. Wilson, Water Conservation in a Steam Stimulation Project, First International Conference on the Future of Heavy Crude and Tar Sands, Edmonton, Alberta, June 8, 1979.

Nearly pure $CO_2$ can be obtained from natural reservoirs or from certain manufacturing processes. Such $CO_2$ must be dried, compressed and transported by pipe line to the point of use for EOR. However these sources of $CO_2$ are limited in quantity and cannot supply the predicted demand. $CO_2$ can be generated by burning fuel in a conventional boiler, absorbing $CO_2$ from the flue gas with certain organic solvents, stripping the $CO_2$ from the solvent, and compressing the $CO_2$ for use. It has been reported that as much as one-half of the energy produced by burning the fuel for this process must be used for stripping the $CO_2$ from the solvent. Oxides of nitrogen are produced and must be removed from the gas stream. In any case, the produced water must be treated and disposed of.

Inert gas can also be generated by burning clean fuel. The combustion must be carefully controlled so as to minimize residual oxygen and oxides of nitrogen. Since the gas must be compressed after combustion, careful treatment is required to eliminate corrosion and fouling in the compressor.

Many of the disadvantages of the prior art processes are avoided or minimized by the present invention which employs wet oxidation as a source of the injection gas. Wet oxidation is a term used for a self-sustained oxidation of any combustible material, including low grade fuels, organic waste materials, and reduced forms of inorganic materials, in aqueous medium, initiated at elevated temperatures and pressures. The oxidizing agent can be pure oxygen, air or mixtures thereof. The gaseous effluent of the wet oxidation is comprised essentially of water vapor, carbon dioxide and nitrogen (if air is used), although small amounts of carbon monoxide, residual oxygen and volatile organic compounds may be present. Illustrative of prior art wet oxidation processes are those disclosed in Zimmermann U.S. Pat. No. 2,824,058 (Feb. 18, 1958) and Prádt U.S. Pat. No. 4,100,730 (July 18, 1978).

3. Prior Publication

Certain aspects of the instant invention have been described in a manuscript of a paper presented at the First International Conference on the Future of Heavy Crude and Tar Sands in Edmonton, Alberta on June 7, 1979, author Z. G. Havlena. This publication was made subsequent to the time the invention disclosed and claimed herein was made, and the pertinent disclosure of said publication was derived from the inventors of the instant invention.

SUMMARY OF THE INVENTION

The process of the invention is one for enhanced oil recovery by gas injection into oil-bearing formations which comprises wet oxidizing combustible carbonaceous materials with oxygen, air or a mixture of oxygen and air to obtain a gas comprising a mixture of water vapor and carbon dioxide (and nitrogen in the event air is used), substantially free of oxides of sulfur and nitrogen; injecting said gaseous mixture into an oil-bearing formation to produce a mixture of oil and water; extracting said mixture of oil and water from the oil-bearing formation; separating the water from the latter mixture; and recycling the water to the wet oxidation reactor. Residual oil in the recycled water provides additional fuel for the wet oxidation reaction, and at the same time the need for costly water treatment is eliminated.

A modification of the invention relates to a process in which the gas mixture produced by wet oxidation is passed over an oxidation catalyst to effect oxidation of combustible constituents of said gas with residual oxygen in said gas, prior to its injection into the oil-bearing formation.

A further modification of the invention relates to a process in which a portion of the water vapor in the gas mixture produced by wet oxidation is removed by condensation prior to injection of the gas into the oil formation.

A still further modification of the invention relates to a process in which the hot reactor gas from the wet oxidation is cooled to condense a portion or all of the water vapor content thereof to produce a liquid condensate; said liquid condensate is reconverted to water vapor by heat exchange with hot reactor gas; and said water vapor is injected into the oil-bearing formation. Alternatively, the hot reactor gas from the wet oxidation step is cooled to remove a portion or all of the water vapor content, and the resulting cooled reactor gas is injected into the oil-bearing formation.

A still further modification of the invention relates to a process in which the hot reactor gas from wet oxidation is cooled to condense substantially all of the water vapor content thereof, and the cooled reactor gas, comprised essentially of carbon dioxide or carbon dioxide and nitrogen, is injected into an oil-bearing formation. Oil-bearing formations frequently contain indigenous water which is extracted along with the oil in the process of the invention. The water thereby produced, along with any residual oil, is recycled to the wet oxidation step.

A still further modification of the invention relates to a process in which a part or all of the water produced by condensation from the hot reactor gas is recycled to the wet oxidation step. Said water contains dissolved carbon dioxide which is thereby also recycled for use in the oil reclamation process.

A still further modification of the invention relates to a process in which the hot reactor gas from wet oxidation is cooled by indirect heat exchange with conventional feedwater to condense a portion or substantially all of the water vapor content thereof, and the cooled reactor gas is injected into an oil-bearing formation. A portion of the liquid condensate is recycled to the wet oxidation step together with produced water.

A still further modification of the invention relates to apparatuses for carrying out the process of the invention, as described hereinbelow and in the accompanying drawings.

DETAILED DESCRIPTION INCLUSIVE OF PREFERRED EMBODIMENTS

It has been discovered that the techniques known as wet air oxidation (WAO) or wet oxidation, can produce gas mixtures as described above for use in EOR, using inexpensive carbonaceous fuels or wastes with no air pollution and using produced water or other water of poor quality directly without pretreatment. An appropriate type of WAO system is described in Pradt U.S. Pat. No. 4,100,730. This variation of WAO can produce gaseous mixtures of steam, carbon dioxide and nitrogen at high pressure and in controlled ratios without the use of heat transfer surfaces.

Figure 1:
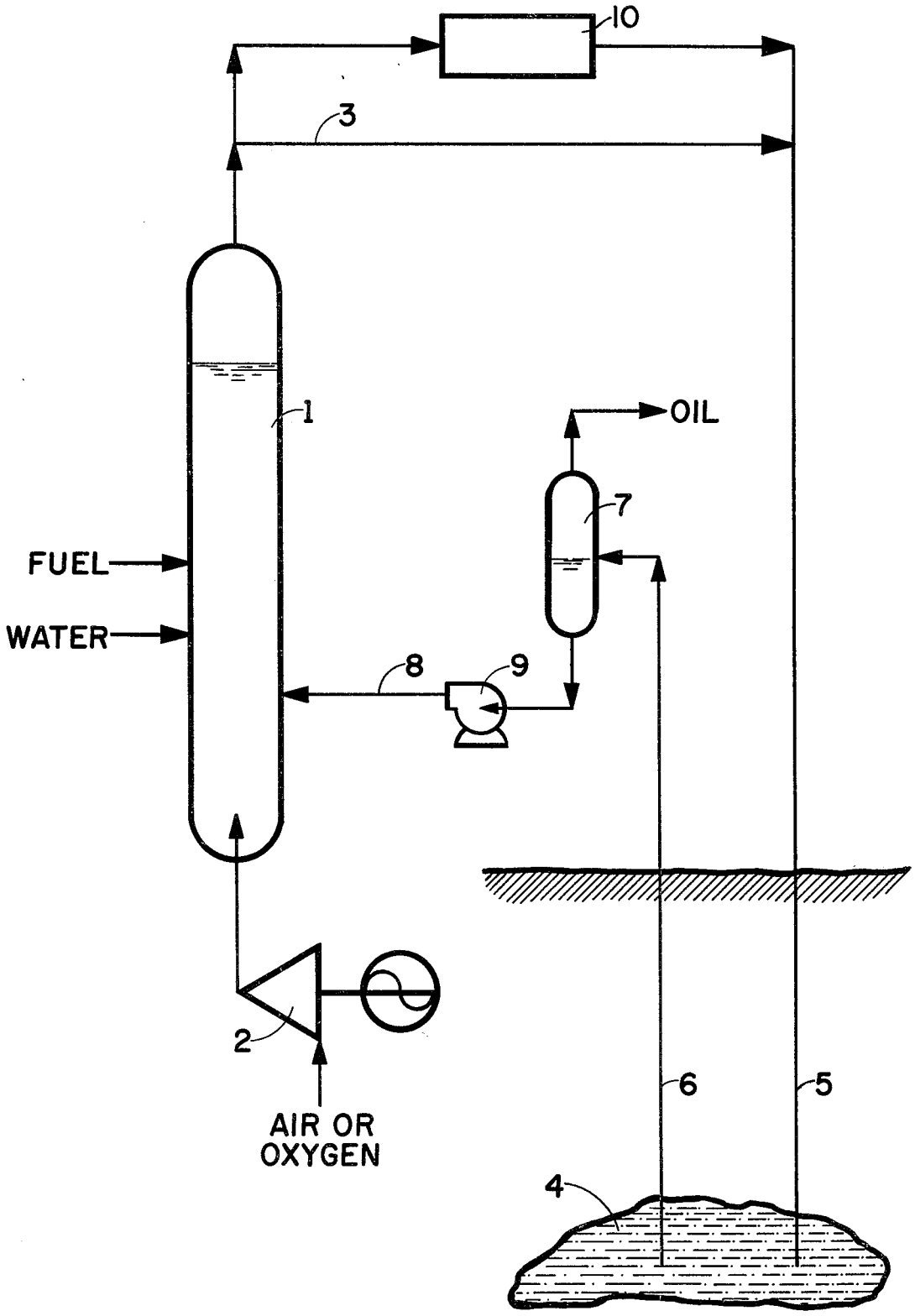
FIG. 1 is a flow-sheet representation of the process of the invention.

Referring now to FIG. 1, 1 is a wet oxidation reactor into which carbonaceous fuel, water and oxygen or an oxygen-bearing gas are injected. Oxygen or air is pressurized by compressor 2. In the reactor the fuel is oxidized to form carbon dioxide, water and traces of intermediate organic compounds. A gas mixture consisting essentially of carbon dioxide, nitrogen and water vapor exits from the reactor through line 3 and is injected through well 5 into oil reservoir 4. Alternatively, the gas mixture from the reactor may be passed through catalytic vapor phase oxidizer 10 to destroy residual combustible components of the gas mixture, generate additional carbon dioxide and superheat the mixture. Oil, water and gas are produced from the reservoir through well 6. In the cyclic so-called "huff and puff" EOR technique the same well would be used for both injections and production. The produced water is separated from the oil in device 7 and is recycled, together with any residual oil, to the reactor through line 8 by pump 9.

Figure 2:
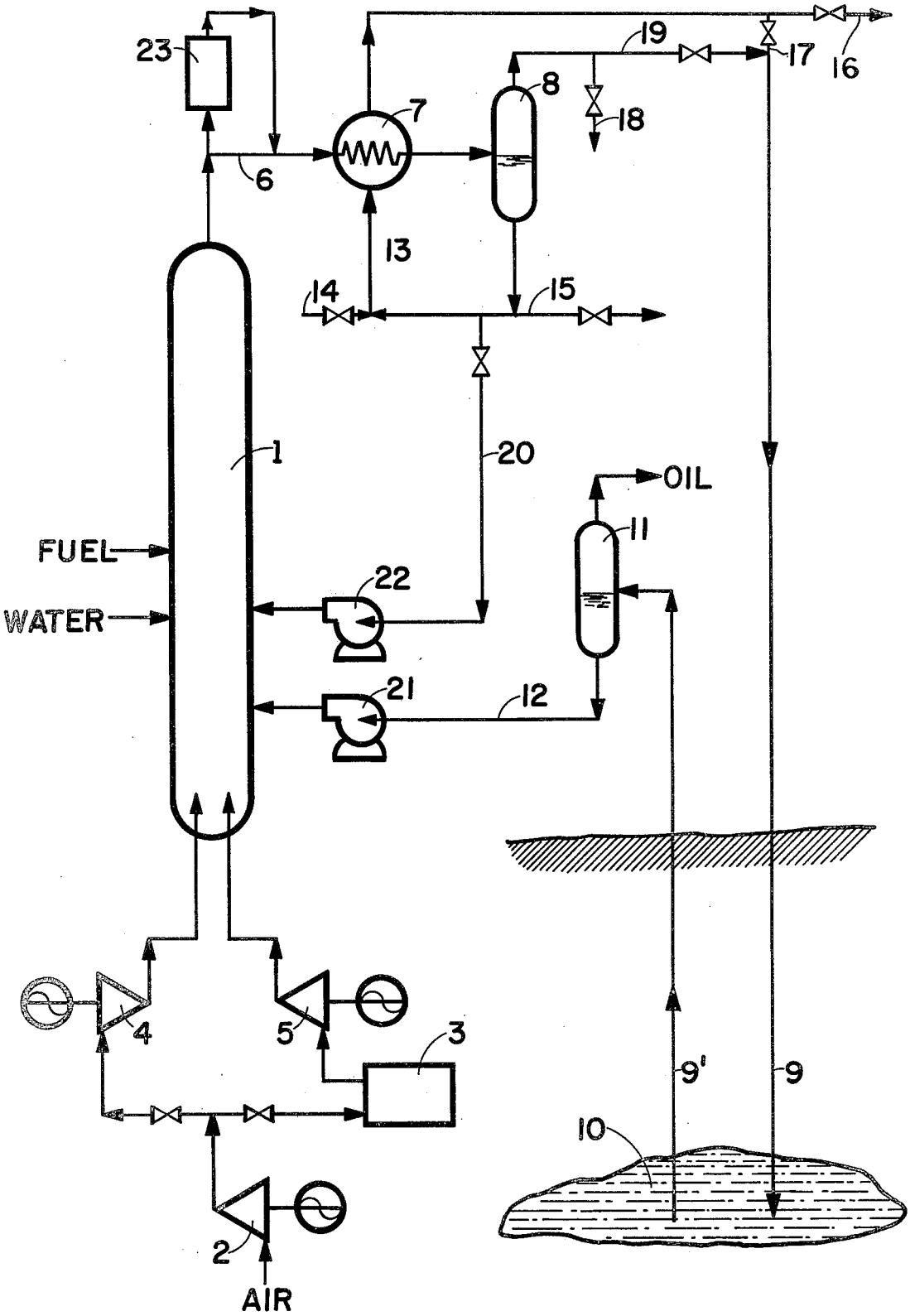
FIG. 2 is a flow-sheet representation showing a preferred embodiment of the invention.

A preferred embodiment of this invention is shown in the accompanying FIG. 2.

1 is a wet oxidation reactor into which carbonaceous fuel, water and oxygen or an oxygen-bearing gas are injected. Air is compressed to an intermediate pressure by compressor 2 and fed either to an oxygen generator 3 or a booster air compressor 4 which compresses the air to the reactor pressure. Oxygen from the generator 3 is compressed to reactor pressure by booster compressor 5. By the foregoing system air, oxygen, or a mixture of air and oxygen can be supplied to the wet oxidation reactor. In the reactor the fuel is oxidized to form carbon dioxide, water, and traces of intermediate organic compounds. A gas consisting substantially of carbon dioxide, nitrogen and water vapor exits from the reactor through line 6. This gas is cooled in heat exchanger 7, condensing all or a portion of the water vapor. The liquid and gaseous phases are separated in separator 8, and the gases are injected through well 9 into oil reservoir 10. Oil, water and gas are produced from the reservoir through well 9'. In the cyclic so-called "huff and puff" EOR technique the same well would be used for both injection and production. The produced water is separated from the oil in device 11 and, pressurized by pump 21, is recycled to the reactor through line 12. Gases which may accompany the produced oil and water are separated from the liquid mixture prior to recycling the produced water containing residual oil.

In order to show all of the features of this invention the embodiment of the drawing is additionally equipped with a line 13 so that process condensate (the liquid water condensed from the reactor gas) can be directed from separator 8 to heat exchanger 7 to regenerate water vapor; a line 14 allowing conventional feedwater to be supplied to heat exchanger 7; a line 15 allowing process condensate to be discharged from the system; a pump 22 and a line 20 allowing process condensate to be recycled to the reactor; a line 16 allowing steam from heat exchanger 7 to be discharged to a turbine or other steam-using device; a line 17 allowing steam to be directed to the reservoir; a line 18 allowing the non-condensed gases to be discharged from the system, and a line 19 allowing the non-condensed gases to be injected into the reservoir.

The primary constituents of the wet oxidation reactor gas effluent are water vapor (steam) and carbon dioxide. Nitrogen is also present in the event air is used in the wet oxidation. The proportions of the three gases can readily be varied as desired by (a) controlling the amounts of air and oxygen supplied to the wet oxidation reactor, (b) varying the temperature and/or pressure of the wet oxidation reactor, and (c) controlling the extent of condensation of the water vapor. For example, if substantially pure oxygen only is fed to the wet oxidation reactor, and all of the water vapor is removed by condensation, the resulting gas will consist essentially of carbon dioxide. If air or air plus oxygen is fed to the wet oxidation reactor, and all of the water vapor is removed by condensation, the resulting gas will consist essentially of carbon dioxide and nitrogen in proportion depending on the amount of air used. A gas stream of essentially pure nitrogen may be produced by removing carbon dioxide with absorption by organic or inorganic solvents, or cryogenically.

The ratio of water vapor to other gaseous constituents in the reactor gas effluent is essentially constant at given temperature and pressure conditions, and is approximated by application of the perfect gas law.

The wet oxidation reactor gas contains minor amounts of other substances, including residual oxygen (typically less than about 0.5 percent by weight), carbon monoxide (typically less than about 1.0 percent by weight) and volatile organic compounds (typically less than about 0.5 percent by weight) such as acetic acid. No detectable amounts of oxides of sulfur or nitrogen are present. An optional further aspect of the invention comprises passing the reactor gas over an oxidation catalyst in catalytic oxidizer 23 whereby the residual oxygen and oxidizable compounds (carbon monoxide and volatile organic compounds) are caused to react to form additional carbon dioxide. The oxidation catalyst can be any catalyst used for vapor phase oxidations, for example platinum or palladium supported or carried on alumina, low alloy steel or silica.

Any carbonaceous material combustible by wet oxidation can be used as fuel for the wet oxidation reactor, although it is preferred to use low grade inexpensive fuels such as coal, coke, lignite, peat or biomass (plant matter such as raw cellulose and crop residues, animal manure, etc.); or waste materials such as municipal waste (sewage sludge, etc.) or industrial waste products and oil emulsions.

Several advantages over prior art EOR processes are realized by the instant invention as follows:

In prior art processes, before the water produced can be recycled to a conventional steam generator or disposed of, it must be treated separately to remove pollutants. In the instant invention, the wet oxidation reactor serves to remove pollutants as well, oxidizing carbonaceous pollutants such as residual oil in the produced water to produce additional steam and carbon dioxide; thus more efficient use of the produced water is realized than in the prior art, since pretreatment thereof can be avoided. By the same token, the integrated wet oxidation system serves to dispose of combustible wastes, avoids pollution of the atmosphere and surface environment, and provides a readily available and abundant source of carbon dioxide.

At times it may be useful to use conventional feedwater to cool reactor gas to condense water vapor contained therein. Such is particularly useful when injecting cooled gases into a reservoir where the produced water volume is insufficient to meet the needs of the wet oxidation. A portion or all of the liquid condensate is recycled to the reactor, while steam produced from the conventional feedwater may be used in another injection well or elsewhere. Conventional feedwater may be any water usable in conventional boilers, generally treated to reduce hardness and control pH.

The following examples will further illustrate the invention without the latter being limited thereby.

EXAMPLE 1

Wet oxidation of an aqueous suspension of heavy oil was carried out in a reactor at 280° C. and 1055 psig by feeding substantially pure oxygen thereto at such a rate that substantially all of the oxygen was consumed. The gaseous effluent from the reactor had the following analysis:

| Component | Parts by Weight |
|---|---|
| Water vapor | 1000 |
| Carbon dioxide | 60.9 |
| Carbon monoxide | 8.9 |
| Acetic acid | 2.4 |
| Oxygen | 1.35 |
| Other volatile organic compds. | 0.27 |

This gaseous effluent can be injected directly into an underground oil reservoir to bring up a mixture of oil and water. The latter mixture is separated and the water recycled, together with any residual oil, to the wet oxidation reactor.

Alternatively, a portion of the water vapor is removed by condensation and the remaining gas injected into the oil reservoir.

In the foregoing example if air is used in place of pure oxygen there will be 600 parts by weight of nitrogen in the gaseous effluent in addition to the other components. If air is mixed with oxygen there will be proportionally lesser amounts of nitrogen.

The residual oxygen in the gaseous effluent can be eliminated by passing the gas over an oxidation catalyst such as platinum or palladium whereby the oxygen reacts with the carbon monoxide or volatile organic compounds to produce additional carbon dioxide. In this instance the residual oxygen is insufficient to react with all of the carbon monoxide and volatile organics. If it is desired to remove all combustible substances, additional oxygen can be added to the effluent prior to catalytic oxidation.

EXAMPLE 2

This example illustrates the operation of the invention when it is desired to inject a reservoir for an initial period with substantially pure steam, followed by a second period of injection with a mixture of steam and carbon dioxide, followed by a final period of injection with a mixture of steam, carbon dioxide and nitrogen.

With reference to FIG. 2, the wet oxidation reactor 1 is initially supplied with oxygen through compressors 2 and 5 and oxygen generator 3. The gaseous effluent from the wet oxidation reactor is passed through heat exchanger 7 where a portion of the water vapor content of the effluent is condensed and collected in separator 8. The condensate, free of scale-forming dissolved salts is revaporized by heat exchange with hot reactor effluent gas and the resulting substantially pure steam is injected through lines 17 and 9 into the reservoir. The non-condensed gases comprising steam and carbon dioxide are discharged through line 18 during the first period of injection with substantially pure steam; then during the second period the steam and carbon dioxide are injected into the reservoir through line 19. The amount of cooling in heat exchanger 7 can be regulated so as to control the steam:carbon dioxide ratio in separator 8 and then in line 19. Excess substantially pure steam or hot water generated in heat exchanger 7 can be discharged through 16. In the final period the reactor is supplied with oxygen plus air from compressor 4. The quantity of air is adjusted so as to provide the desired amount of nitrogen in the gases separated in separator 8 and thence going to the reservoir.

EXAMPLE 3

This example illustrates the operation of the invention when it is desired to inject a reservoir initially with carbon dioxide and then at a later period with a mixture of carbon dioxide and nitrogen.

The apparatus of FIG. 2 is operated so as to supply the reactor with substantially pure oxygen as in the first per?od of Example 2, but the heat exchanger 7 is operated to obtain maximum cooling of the reactor gas thereby condensing substantially all of the water vapor. The gas obtained in separator 8 consists essentially of carbon dioxide which is then injected through line 19 into well 9 and reservoir 10. In the later period air is introduced into the reactor through compressor 4 to provide a mixture of carbon dioxide and nitrogen the proportion of which can be regulated by varying the air-oxygen ratio.

Oil and water produced from the reservoir through well 9' are separated in device 11; separated water, together with any residual oil, is recycled to the reactor by pump 21 through line 12.

Alternatively, condensate from separator 8 may be recycled to the reactor by pump 22 through line 20 in place of or in addition to produced water.

In processes such as that illustrated in this example, and particularly where the volume of produced water is insufficient to supply the wet oxidation needs, conventional feedwater may be supplied through line 14 to heat exchanger 7. The relatively low temperature of feedwater provides a more efficient cooling of reactor gases.

We claim:

1. A process of enhanced oil recovery by gas injection into oil-bearing formations, which comprises wet oxidizing combustible carbonaceous materials with an approximately stoichiometric quantity of substantially pure oxygen to obtain a gas comprising a mixture of water vapor and carbon dioxide substantially free of oxides of sulfur and nitrogen; injecting said gaseous mixture into an oil-bearing formation to produce a mixture of oil and water; extracting said mixture of oil and water from the oil-bearing formation; substantially separating the water from the latter mixture; and recycling the water, including any residual oil contained therein, to the wet oxidation reactor.

2. A process according to claim 1 in which a portion of the water vapor in the gas mixture produced by wet oxidation is removed by condensation prior to injection of the gas into the oil-bearing formation.

3. A process according to claim 2 in which the water vapor in the gas mixture produced by wet oxidation is cooled and condensed by heat exchange with conventional feedwater.

4. A process according to claim 2 in which a part or all of the condensed water so formed is recycled to the wet oxidation step.

5. A process according to claim 1 in which the gas mixture produced by wet oxidation contains residual oxygen present to the extent of less than about 0.5 percent by weight.

6. A process according to claim 5 in which said gas mixture is passed over an oxidation catalyst to cause reaction of oxidizable constituents of said gas mixture with said residual oxygen, whereby additional carbon dioxide is produced.

7. A process according to claim 1 in which the gas mixture produced by wet oxidation is passed over an oxidation catalyst and a portion of the water vapor content of said gas mixture is removed by condensation prior to injection of the gas into the oil-bearing formation.

8. A process according to claim 7 in which the water vapor in the gas mixture produced by wet oxidation is cooled and condensed by heat exchange with conventional feedwater.

9. A process according to claim 7 in which a part or all of the condensed water so formed is recycled to the wet oxidation step.

10. A process according to claim 1 in which the combustible materials are low grade fuels or waste materials.

11. A process for enhanced oil recovery by gas injection into oil-bearing formations, which comprises:

(a) wet oxidizing combustible carbonaceous materials with an approximately stoichiometric quantity of substantially pure oxygen to obtain a hot reactor gas comprising a mixture of water vapor and carbon dioxide substantially free of oxides of sulfur and nitrogen;

(b) cooling said reactor gas to condense a portion or all of the water vapor content thereof to produce a liquid condensate;

(c) regenerating water vapor by heat exchange of said liquid condensate with hot reactor gas obtained in step (a);

(d) injecting said water vapor regenerated in step (c) into an oil-bearing formation to produce a mixture of oil and water;

(e) extracting said mixture of oil and water from the oil-bearing formation;

(f) substantially separating the water from said mixture of oil and water; and (g) recycling said water, including any residual oil contained therein, to the wet oxidation step (a).

12. A process according to claim 11 in which the gas mixture produced by wet oxidation is passed over an oxidation catalyst prior to the condensation step (b).

13. A process for enhanced oil recovery by gas injection into oil-bearing formations, which comprises:

(a) wet oxidizing combustible carbonaceous materials with an approximately stoichiometric quantity of substantially pure oxygen to obtain a hot reactor gas comprising a mixture of water vapor and carbon dioxide substantially free of oxides of sulfur and nitrogen;

(b) cooling said reactor gas to condense a portion or all of the water vapor content thereof to produce a liquid condensate;

(c) injecting the cooled reactor gas obtained in step (b) into an oil-bearing formation to produce a mixture of oil and water;

(d) extracting said mixture of oil and water from the oil-bearing formation;

(e) substantially separating the water from said mixture of oil and water; and (f) recycling said water, including any residual oil contained therein, to the wet oxidation step (a).

14. A process according to claim 13 in which the gas mixture produced by wet oxidation is passed over an oxidation catalyst prior to the condensation step (b).

15. A process according to claim 13 in which part or all of the liquid condensate from step (b) is recycled to the wet oxidation step (a).

16. A process according to claim 13 in which the water vapor in the gas mixture produced by wet oxidation is cooled and condensed by heat exchange with conventional feedwater.

17. A process of enhanced oil recovery by gas injection into oil-bearing formations, which comprises wet oxidizing combustible carbonaceous materials with air or a mixture of air and oxygen containing an approximately stoichiometric quantity of oxygen to obtain a gas comprising a mixture of water vapor, carbon dioxide and nitrogen substantially free of oxides of sulfur and nitrogen; injecting said gaseous mixture into an oil-bearing formation to produce a mixture of oil and water; extracting said mixture of oil and water from the oil-bearing formation; substantially separating the water from the latter mixture; and recycling the water, including any residual oil contained therein, to the wet oxidation reactor.

18. A process according to claim 17 in which a portion of the water vapor in the gas mixture produced by wet oxidation is removed by condensation prior to injection of the gas into the oil formation.

19. A process according to claim 18 in which the water vapor in the gas mixture produced by wet oxidation is cooled and condensed by heat exchange with conventional feedwater.

20. A process according to claim 18 in which a part or all of the condensed water so formed is recycled to the wet oxidation reactor.

21. A process according to claim 17 in which the gas mixture produced by wet oxidation contains residual oxygen present to the extent of less than about 0.5 percent by weight.

22. A process according to claim 21 in which said gas mixture is passed over an oxidation catalyst to cause reaction of oxidizable constituents of said gas mixture with said residual oxygen, whereby additional carbon dioxide is produced.

23. A process according to claim 17 in which the gas mixture produced by wet oxidation is passed over an oxidation catalyst and a portion of the water vapor content of said gas mixture is removed by condensation prior to injection of the gas into the oil-bearing formation.

24. A process according to claim 23 in which the water vapor in the gas mixture produced by wet oxidation is cooled and condensed by heat exchange with conventional feedwater.

25. A process according to claim 23 in which a part or all of the condensed water so formed is recycled to the wet oxidation step.

26. A process according to claim 17 in which the combustible materials are low grade fuels or waste materials.

27. A process for enhanced oil recovery by gas injection into oil-bearing formations, which comprises:

(a) wet oxidizing combustible carbonaceous materials with air or a mixture of air and oxygen containing an approximately stoichiometric quantity of oxygen to obtain a reactor gas comprising a mixture of water vapor, carbon dioxide and nitrogen substantially free of oxides of sulfur and nitrogen;

(b) cooling said reactor gas to condense a portion or all of the water vapor content thereof to produce a liquid condensate;

(c) regenerating water vapor by heat exchange of said liquid condensate with hot reactor gas obtained in step (a);

(d) injecting said water vapor regenerated in step (c) into an oil-bearing formation to produce a mixture of oil and water;

(e) extracting said mixture of oil and water from the oil-bearing formation;

(f) substantially separating the water from said mixture of oil and water; and (g) recycling said water, including any residual oil contained therein, to the wet oxidation step (a).

28. A process for enhanced oil recovery by gas injection into oil-bearing formations, which comprises:

(a) wet oxidizing combustible carbonaceous materials with air or a mixture of air and oxygen containing an approximately stoichiometric quantity of oxygen to obtain a reactor gas comprising a mixture of water vapor, carbon dioxide and nitrogen substantially free of oxides of sulfur and nitrogen;

(b) cooling said reactor gas to condense a portion or all of the water vapor content thereof to produce a liquid condensate;

(c) injecting the cooled reactor gas obtained in step (b) into an oil-bearing formation to produce a mixture of oil and water;

(d) extracting said mixture of oil and water from the oil-bearing formation;

(e) substantially separating the water from said mixture of oil and water; and (f) recycling said water, including any residual oil contained therein, to the wet oxidation step (a).

29. A process according to claim 28 in which part or all of the liquid condensate from step (b) is recycled to the wet oxidation step (a).

30. A process according to claim 28 in which the water vapor in the gas mixture produced by wet oxidation is cooled and condensed by heat exchange with conventional feedwater.

31. A process according to claim 28 in which the gas mixture produced by wet oxidation is passed over an oxidation catalyst prior to the condensation step (b).

32. A process for enhanced oil recovery by gas injection into oil-bearing formations, which comprises:

(a) wet oxidizing combustible carbonaceous materials with oxygen, air or a mixture of air and oxygen containing an approximately stoichiometric quantity of oxygen to obtain a reactor gas comprising a mixture of water vapor, carbon dioxide and, in the event air is used, also nitrogen, substantially free of oxides of sulfur and nitrogen;

(b) cooling said reactor gas to condense substantially all of the water vapor content thereof;

(c) injecting the cooled reactor gas obtained in step (b) comprised essentially of carbon dioxide or carbon dioxide and nitrogen into an oil-bearing formation also containing water to produce a mixture of oil and water;

(d) extracting said mixture of oil and water from the oil-bearing formation;

(e) substantially separating the water from said mixture of oil and water; and (f) recycling said water, including any residual oil contained therein, to the wet oxidation step (a).

33. A process according to claim 32 in which the gas mixture produced by wet oxidation is passed over an oxidation catalyst prior to the condensation step (b).

34. A process according to claim 32 in which a part or all of the water condensed in step (b) is recycled to the wet oxidation step (a).

35. A process according to claim 32 in which the water vapor in the gas mixture produced by wet oxidation is cooled and condensed by heat exchange with conventional feedwater.

36. An apparatus for enhanced recovery of oil from an oil-bearing formation, comprising:

(a) a reactor for wet oxidation of carbonaceous fuel to generate a water vapor containing gas, said reactor having inlets for supplying fuel, water and air or oxygen;

(b) a well for injecting gas into an oil-bearing formation;

(c) conduit means for delivering generated gas to said injection well;

(d) a well for producing a mixture of oil and water from said formation;

(e) means for separating said mixture into a produced oil stream and a produced water stream;

(f) pumping means for pressurizing the produced water stream; and (g) conduit means for introducing the produced water stream into the reactor.

37. The apparatus according to claim 36, including a catalytic vapor phase oxidizer to oxidize said generated gas.

38. An apparatus for enhanced recovery of oil from an oil-bearing formation, comprising:

(a) a reactor for wet oxidation of carbonaceous fuel to generate a water vapor containing gas, said reactor having inlets for supplying fuel, water and air or oxygen;

(b) means for cooling said generated gas to condense a portion or all of the water vapor contained therein;

(c) means to separate condensed water from the remaining cooled gas stream;

(d) a well for injecting gas into an oil-bearing formation;

(e) conduit means for delivering said remaining cooled gas stream to said injection well;

(f) a well for producing a mixture of oil and water from said formation;

(g) means for separating said produced mixture into a produced oil stream and a produced water stream;

(h) pumping means for pressurizing the produced water stream; and (i) conduit means for introducing the produced water stream into the reactor.

39. The apparatus according to claim 38, wherein said cooling means comprises a heat exchanger wherein the cooled condensed water obtained in part (c) is evaporated to water vapor by indirect heat exchange with hot generated gas from the reactor; conduit means for delivering said cooled condensed water to said heat exchanger; and conduit means to deliver said regenerated water vapor to said injection well.

40. The apparatus according to claim 38, wherein said cooling means comprises a heat exchanger wherein conventional feedwater is heated to generate water vapor by indirect heat exchange with hot generated gas from the reactor; an inlet for introducing said conventional feedwater to the heat exchanger; and means to compress and deliver the condensed water obtained in part (c) to the reactor.

* * * * *